United States Patent [19]

Trützschler

[11] 4,259,765

[45] Apr. 7, 1981

[54] BALE SUPPORTING DEVICE FOR A BALE OPENER

[75] Inventor: Hermann Trützschler, Mönchen-Gladbach, Fed. Rep. of Germany

[73] Assignee: Trützschler GmbH & Co. KG, Mönchen-Gladbach, Fed. Rep. of Germany

[21] Appl. No.: 943,976

[22] Filed: Sep. 20, 1978

[30] Foreign Application Priority Data

Oct. 7, 1977 [DE] Fed. Rep. of Germany ..... 2745121

[51] Int. Cl.[3] ..... D01G 7/04

[52] U.S. Cl. ..... 19/80 R; 100/269 A

[58] Field of Search ..... 29/700, 714, 426; 100/220, 267, 269 A; 19/80, 145.5, 80 R

[56] References Cited

U.S. PATENT DOCUMENTS

| | | | |
|---|---|---|---|
| 2,739,749 | 3/1956 | Davidson | 100/269 A |
| 3,110,062 | 11/1963 | Wildbolz et al. | 19/80 R |
| 3,208,106 | 9/1965 | Leineweber et al. | 19/80 R |
| 3,248,001 | 4/1966 | McGinnis | 100/269 A |
| 3,470,585 | 10/1969 | Just | 19/80 R |
| 3,514,969 | 6/1970 | Harza | 100/269 A |
| 3,550,237 | 12/1970 | Metzger | 29/700 |
| 3,686,714 | 8/1972 | Wirth | 19/80 R |
| 3,805,354 | 4/1974 | Guthrie | 29/700 |
| 3,882,770 | 5/1975 | Bleasdale | 100/220 |

FOREIGN PATENT DOCUMENTS 1154741 4/1964 Fed. Rep. of Germany .

*Primary Examiner*—Louis Rimrodt
*Attorney, Agent, or Firm*—Spencer & Kaye

[57] ABSTRACT

A bale opener includes guide elements for bilaterally bounding a space in which a bale to be opened is accommodated, bale opening elements for opening the bale at its underside and a bale supporting device arranged above the bale for engaging an upper face of the bale and for exerting thereon a downwardly oriented pressing force.

11 Claims, 2 Drawing Figures

FIG. 1
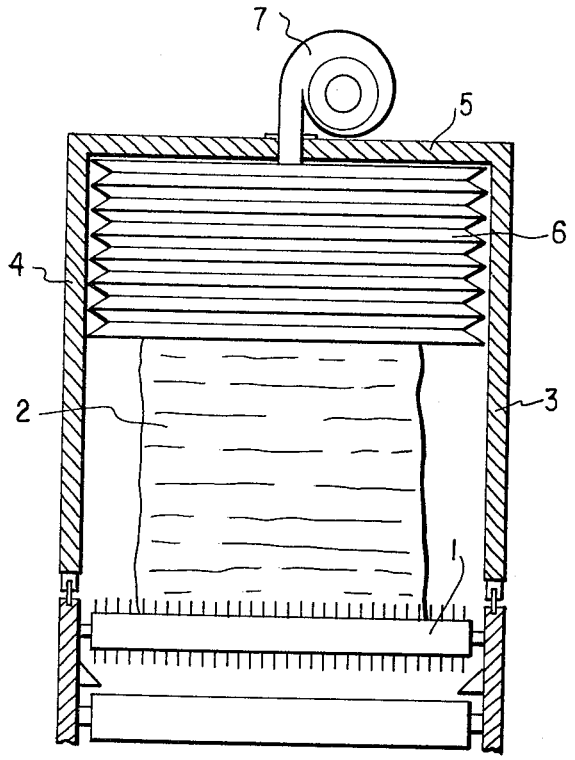
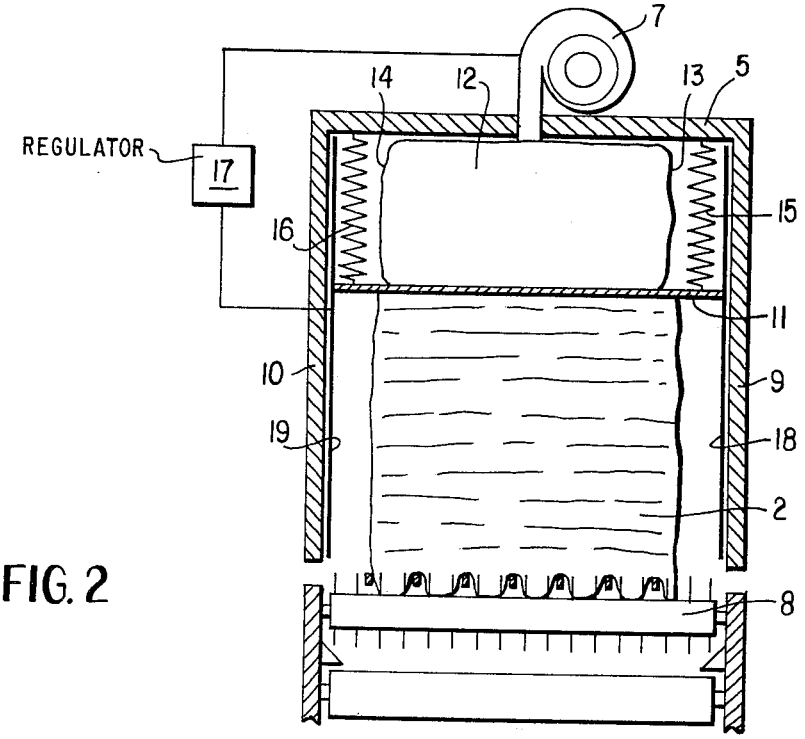
FIG. 2

BALE SUPPORTING DEVICE FOR A BALE OPENER

BACKGROUND OF THE INVENTION

This invention relates to a device for supporting textile fiber bales which are positioned serially in a space between bale guide plates on a bale opener and which are opened at their underside.

As the bale ties are removed, the bales expand, particularly in an upward direction and thus increase substantially in height. Thus, upon tie removal, the previously firmly compressed bale is released and becomes an unstable body. In practice, it is difficult to properly support this unstable body, because in the working direction—that is, in the direction of the relative motion between bale bottom and opening tool—the bale is adjoined by other unstable bales. Between the bale and, for example, a bale guide plate, there is provided an intermediate lateral space which can be adjusted dependent upon the bale width. Such an arrangement, however, requires additional labor. The width setting depends on the dimensions of the widest bale. During the shifting of the bales, the latter rub against the guide plates; this amplifies the tendency of the bales to topple in the working direction. This tendency is particularly pronounced during the start of the bale opening operation, and when the conveying mechanism reverses its direction of rotation. It is a further disadvantage of the above-outlined arrangement that as the opening operation is in progress, the pressure of the bale on the opening elements is decreased because of the decreasing bale weight.

SUMMARY OF THE INVENTION

It is an object of the invention to provide an improved bale supporting device of the above-outlined type from which the discussed disadvantages are eliminated and which thus firmly supports bales of any shape and size during the opening process and which ensures a uniform pressure by the bales on the opening elements independently of the progress of the opening process.

This object and others to become apparent as the specification progresses, are accomplished by the invention, according to which, briefly stated, above the bales there is arranged a movable support device which presses the bales downwardly.

The movable support device, provided according to the invention, makes possible a stable positioning of the bales, since the support device, by virtue of its mobility, engages the bale independently from the dimension and shape thereof. The fiber bales of unlike height are first placed in a space between the bale guide plates, whereupon the support device is moved in the direction of the bale. In this manner there is achieved an automatic adaptation of the support device to the fiber bale independently from its height. Thus, in a simple manner, a firm support and consequently a stable positioning of the bales of any shape and dimension is ensured during the entire opening process. Further, the invention provides that the unstable height expansion occurring as a result of the release of the bale is reduced. The support device according to the invention may find application in bale openers which operate with fixed opening elements such as spiked lattices, spiked rolls or the like and movable bales as well as bale openers having shifting opening elements and stationarily supported bales.

According to an advantageous feature of the invention, the pressing force of the support device is adjustable as a function of the bale weight to ensure that, as the opening process is in progress, the pressing force affecting the opening elements directly or with the intermediary of bale support elements such as grates, is maintained at a constant level.

Expediently, the lateral guide elements, such as bale guide plates are connected with one another by means of a roof element, such as a roof plate, in which case the bale support device is arranged between the roof plate and the bale. The support device engages, on the one hand, the inner side of the roof plate and is, on the other hand, in contact with the top face of the bale. Preferably, the support device can be pressed down in a vertical direction in order to achieve a uniform surface pressure. Elastic elements, such as compression springs may be used to move the support device. Preferably, the support device has an inflatable member, such as a bellows or an air bag which is closed at all sides and which, by compressed air introduced thereinto, can be pressed against the bales as a simple and reliable structure. Preferably, the support device includes an elastic return member such as a rubber band or a tension spring to move the pressing element away from the bale upon removal of the pressing force. In case a blower is used in conjunction with an inflatable member, the return force may be generated by a reverse pressure (suction).

According to a further feature of the invention, the support device is connected with a sensor arrangement, such as a light barrier or a sliding sensor for determining the actual height of the textile fiber bale. The sensor arrangement is, in turn, connected with a pressure regulator for controlling the pressing force on the bale, dependent upon the bale weight which, as discussed above, gradually decreases as the opening process progresses. The setting member for the pressure regulator may be a pneumatic element such as a blower or a mechanical pressing element.

BRIEF DESCRIPTION OF THE DRAWINGS

FIG. 1 is a schematic sectional front elevational view of a preferred embodiment of the invention.

FIG. 2 is a schematic sectional front elevational view of another preferred embodiment of the invention.

DESCRIPTION OF THE PREFERRED EMBODIMENTS

Turning now to FIG. 1, there is shown a bale opener which has stationarily arranged (that is, non-travelling) spiked lattices 1 serving as opening elements and supporting, between lateral guide plates 3 and 4, textile fiber bales 2, which are shiftable during operation (only one is visible). The lateral bale guide plates 3 and 4 are connected to one another by means of a horizontal roof plate 5. The interconnected bale guide plates 3 and 4 move with the bales 2 in the working direction (which is perpendicular to the plane of the drawing).

Between the bale 2 and the inner face of the roof plate 5 there is provided a bellows 6 forming part of a bale supporting device according to the invention. The bellows 6 projects laterally beyond the outline of the bale 2 on either side and extends approximately to the guide plates 3 and 4. In this manner it is ensured that the underside of the bellows 6 can engage the bale 2 along its entire upper face. On the external upper face of the roof plate 5 there is mounted a reversible blower 7 which introduces compressed air into the inner space of the bellows 6 or, if reversed, withdraws the air therefrom. The blower 7 and the bellows 6 travel with the plates 3, 4 and 5 as a unit with the associated bale 2 during the opening operation.

Turning now to FIG. 2, there is illustrated a bale opener with a travelling opening mechanism 8 and stationary bales 2 (only one is visible). The lateral guide plates 9, 10 are interconnected at their upper edges by means of the roof plate 5 and remain stationary during the bale opening operation. Above the bale 2 there is arranged a pressing plate 11. Between the pressing plate 11 and the inner face of the roof plate 5 there is arranged on air bag 12 which is made, for example, of a synthetic material and which is closed at all sides. Between the lateral walls 13 and 14 of the air bag 12 and the inner faces of the guide plates 9 and 10 elastic elements such as tension springs 15 and 16 are provided which urge the pressing plate 11, together with the air bag 12, in a direction away from the bale 2. The air bag 12 is inflatable by a blower 7 mounted on the roof plate 5. Further, the blower 7 (pressure setting member) is connected, with the intermediary of a pressure regulator 17, with a light barrier (sensor member) formed of a light source 18 and a light receiver 19 for automatically increasing the pressure within the air bag 12 as the weight of the bale 2 decreases during the bale opening operation to thus maintain the total pressing force of the bale on the opening elements constant. The light source 18 and the light receiver 19 are arranged on either side of the bale along the entire height of the guide plates. The intermediate space between the light source 18 and the light receiver 19 is occupied solely by the air bag 12 and thus the bale 2 does not project thereinto. For this purpose the air bag 12 may, for example, project in the working direction beyond the outline of the bale 2. It is further feasible to provide an arrangement in which the intermediate space between the light source 18 and the light receiver 19 is occupied solely by the bale 2 rather than the air bag 12.

In operation, the light barrier 18, 19 applies an input signal (sensor signal) to the regulator 17 as a function of the height level of the pressing plate 11, which corresponds to the height level of the upper face of the bale (which, in turn, is a measure of the bale weight). In response to the input signal, the regulator 17 applies a setting signal to the blower 7 to vary the inflated state of the air bag 12. The regulator 17 is preset in such a manner that as the height level of the upper bale face drops because of the decreasing bale height as the bale opening operation is in progress, the pressing force of the air bag 12 is increased, so that despite the decreasing weight of the bale, its downwardly exerted force may remain constant. It is feasible, for example, to use a bale weight sensor as the variable input signal generating arrangement, instead of the light barrier 18, 19. It is further to be understood that an automatic pressing force adjustment of the above-described type may also form part of the FIG. 1 embodiment.

The bale guide plates 3 and 4 and the roof plate 5 are simultaneously allied to several bales 2. According to the first embodiment a bellows 6 or an air bag 12 can be allied to each bale 2. According to another embodiment one bellows 6 or one air bag 12 may also simultaneously serve several bales 6.

It will be understood that the above description of the present invention is susceptible to various modifications, changes and adaptations, and the same are intended to be comprehended within the meaning and range of equivalents of the appended claims.

What is claimed is:

1. In a bale opener including guide elements for bilaterally bounding a space in which a bale to be opened is accommodated and bale opening elements for opening the bale at its underside, the improvement comprising a bale supporting device arranged above said space for engaging an upper face of the bale and for exerting thereon a continuously vertically downwardly oriented pressing force, said bale supporting device including an inflatable member disposed above said space and a blower operatively connected to said inflatable member for urging the inflatable member into engagement with the upper face of the bale.

2. A bale opener as defined in claim 1, further comprising a roof element connecting said guide elements with one another; said blower being supported on said roof element and said inflatable member being supported underneath said roof element.

3. A bale opener as defined in claim 1, further comprising a vertically movable, generally horizontally oriented pressing plate disposed underneath said inflatable member and being in contact therewith; said pressing plate being arranged for engaging face-to-face the upper face of the bale and pressing it downwardly under the effect of said inflatable member.

4. A bale opener as defined in claim 3, further comprising an elastic return member connected to said pressing plate for urging upwardly said pressing plate and said inflatable member.

5. A bale opener as defined in claim 1, wherein said inflatable member is a bellows.

6. A bale opener as defined in claim 1, wherein said inflatable member is an air bag.

7. In a bale opener including guide elements for bilaterally bounding a space in which a bale to be opened is accommodated and bale opening elements for opening the bale at its underside, the improvement comprising (a) a bale supporting device arranged above said space for engaging an upper face of the bale and for exerting thereon a continuously vertically downwardly oriented pressing force, said bale supporting device including an inflatable member disposed above said space and a blower operatively connected to said inflatable member for urging the inflatable member into engagement with the upper face of the bale;

(b) a sensor emitting a sensor signal as an at least indirect function of the weight of the bale; and (c) control means connected to said sensor for receiving the sensor signal therefrom and for emitting a setting signal as a function of said sensor signal; said control means being further connected to said blower for applying said setting signal to said blower for varying said pressing force exerted by said inflatable member as a function of the weight of the bale.

8. In a bale opener including guide elements for bilaterally bounding a space in which a bale to be opened is accommodated and bale opening elements for opening the bale at its underside, the improvement comprising (a) a bale supporting device arranged above said space for engaging an upper face of the bale and for exerting thereon a continuously vertically downwardly oriented pressing force, said bale supporting device including an inflatable member disposed above said space and a blower operatively connected to said inflatable member for urging the inflatable member into engagement with the upper face of the bale; and (b) control means for determining, at least indirectly, the weight of the bale and for operating said blower as a function of said weight to vary said pressing force exerted by said inflatable member dependent upon said weight.

9. In a bale opener including guide elements for bilaterally bounding a space in which a bale to be opened is accommodated, a roof element situated above said space and connecting together said guide elements, and bale opening elements for opening the bale at its underside; the improvement comprising (a) a bale supporting element arranged above said space underneath said roof element for engaging an upper face of the bale and for exerting thereon a continuously vertically downwardly oriented pressing force;

(b) force-applying means connected to said bale supporting element for transmitting to said bale supporting element said pressing force in a variable magnitude;

(c) a sensor emitting a sensor signal as an at least indirect function of the weight of the bale; and (d) control means connected to said sensor for receiving the sensor signal therefrom and for emitting a setting signal as a function of said sensor signal; said control means being further connected to said force-applying means for transmitting said setting signal to said force-applying means for varying said pressing force exerted by said bale supporting element as a function of the weight of the bale.

10. A bale opener as defined in claim 9, further comprising a vertically movable, generally horizontally oriented pressing plate disposed underneath said bale supporting element and being in contact therewith; said pressing plate being arranged for engaging face-to-face the upper face of the bale and pressing the bale downwardly under the effect of said bale supporting element.

11. A bale opener as defined in claim 9, further comprising elastic return means for urging said bale supporting element in an upward direction towards said roof element.

* * * * *